United States Patent [19]

Anceschi et al.

[11] Patent Number: 5,051,111

[45] Date of Patent: Sep. 24, 1991

[54] WHITENER DISPERSION

[75] Inventors: Italo Anceschi, Muttenz; Werner Fringeli, Laufen, both of Switzerland; Martin Jöllenbeck, Solingen, Fed. Rep. of Germany; Georges Mahler, Mulhouse, France; Willy Schürings, Grenzach-Wyhlen, Fed. Rep. of Germany

[73] Assignee: Ciba-Geigy Corporation, Ardsley, N.Y.

[21] Appl. No.: 275,231

[22] Filed: Nov. 22, 1988

[30] Foreign Application Priority Data

Nov. 27, 1987 [CH] Switzerland ..... 4630/87

[51] Int. Cl.[5] ..... C09B 57/00; C09K 11/04

[52] U.S. Cl. ..... 8/648; 252/301.21; 252/301.22; 252/310.23; 252/301.24; 8/922

[58] Field of Search ..... 252/301.21, 301.22, 252/301.23, 301.24; 8/922, 553, 648

[56] References Cited

U.S. PATENT DOCUMENTS

| | | | |
|---|---|---|---|
| 3,575,866 | 4/1971 | Strobel et al. | 252/301.29 |
| 3,928,329 | 12/1975 | Fleck et al. | 252/301.24 |
| 4,070,319 | 1/1978 | Carel et al. | 252/301.21 |
| 4,212,763 | 7/1980 | Fringel | 252/301.23 |
| 4,231,741 | 11/1980 | Gunther et al. | 252/301.23 |
| 4,316,815 | 2/1982 | Mercer et al. | 252/301.22 |
| 4,330,427 | 5/1982 | Martini et al. | 252/301.24 |
| 4,336,155 | 6/1982 | Martini et al. | 252/301.23 |
| 4,363,744 | 12/1982 | Gunther et al. | 252/301.24 |
| 4,400,294 | 8/1983 | Martini et al. | 252/301.24 |
| 4,416,795 | 11/1983 | Martini et al. | 252/301.24 |
| 4,605,511 | 8/1986 | Fringel | 252/301.23 |
| 4,666,627 | 5/1987 | Meyer | 252/301.22 |
| 4,717,502 | 1/1988 | Schmid | 252/301.23 |

OTHER PUBLICATIONS

European Search Report, 88 81 0794.

*Primary Examiner*—John F. Niebling
*Assistant Examiner*—Steven P. Marquis
*Attorney, Agent, or Firm*—George R. Dohmann; Edward McC. Roberts

[57] ABSTRACT

There are disclosed aqueous dispersions comprising water-insoluble or sparingly soluble fluorescent whitening agents, water-soluble fluorescent whitening agents, dispersants, optional solubilizers, further optional assistants and a copolymer of 2-vinylpyrrolidone and 3-vinylpropionic acid, their preparation and the use thereof for whitening polyester/cellulose fiber material. These novel dispersions are storage-stable and temperature-stable.

23 Claims, No Drawings

WHITENER DISPERSION

The present invention relates to an aqueous whitener dispersion and to the preparation thereof, as well as to the use of said dispersion for whitening polyester/cellulose blends.

The novel whitener dispersion is stable in the temperature range up to 40° C. and storage-stable for up to six months and is able to whiten the polyester component and the cellulose component of polyester/cellulose blends simultaneously in one application step, and produces excellent white effects on the treated material.

Accordingly, the present invention relates to a novel aqueous dispersion comprising at least one water-insoluble or sparingly soluble fluorescent whitening agent, an optional solubiliser, at least one anionic, cationic and/or non-ionic surfactant, and further optional assistants, which dispersion additionally comprises a copolymer of 2-vinylpyrrolidone and 3-vinylpropionic acid.

The dispersion of this invention preferably comprises 3–20% of water-insoluble or sparingly soluble fluorescent whitening agent, 4–20% of water-soluble fluorescent whitening agent, 2–20% of dispersant, 5–25% of solubiliser, 1–20% of copolymer of 2-vinylpyrrolidone and 3-vinylpropionic acid, and 0.1–10% of further assistants.

In the present context and throughout this specification, percentages are by weight.

Particularly preferred dispersions comprise 5–10% of water-insoluble or sparingly soluble fluorescent whitening agent, 4–10% of water-soluble fluorescent whitening agent, 2–5% of dispersant, 10–25% of solubiliser, 3–6% of copolymer of 2-vinylpyrrolidone and 3-vinylpropionic acid, and 0.1–5% of further assistants.

The water-insoluble or sparingly fluorescent whitening agents are compounds or mixtures of compounds, for example of the class of the stilbenes, distyrylbenzenes, diphenylbistyryls, triazinyls, benzoxazoles, bis(benzoxazoles), bis(benzoxazolyl)thiophenes, bis(benzoxazolyl)naphthalenes, pyrenes, coumarins and naphthalene-peridicarboximides. Preferred compounds are those of formulae:

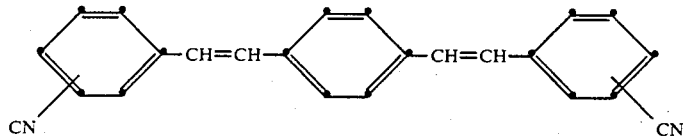

(1)

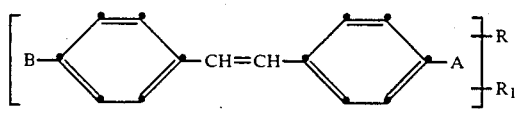

(2)

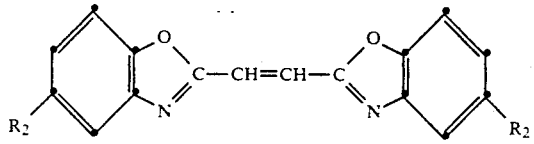

(3)

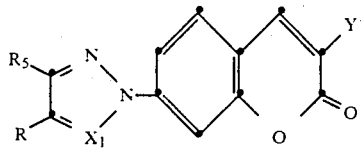

(4)

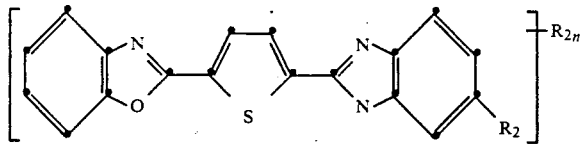

(5)

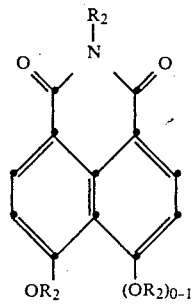

(6)

wherein

A=2-benzoxazolyl, —CH=CH—CN, —CH=CH—COOR$_2$, —COOR$_2$ or halogen,
B=phenyl if A is 2-benzoxazolyl,
B=—CH=CH—CN if A is —CH=CH—CN,
B=—CH=CH—COOR$_2$ if A is —CH=CH—COOR$_2$,
B=2-benzoxazolyl if A is —COOR$_2$,
B=naphthalene-triazolyl if A is halogen or —COOR$_2$,
B=1,2,4-oxadiazole if A is 2-benzoxazolyl, and
R=H, C$_1$-C$_4$alkyl,
R$_1$=H, C$_1$-C$_4$alkyl and CN,
R$_2$=C$_1$-C$_4$alkyl,
R$_5$=C$_1$-C$_4$alkyl or phenyl,
X=C, N
Y=phenyl or a radical of formula

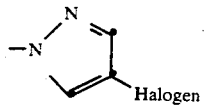

and
n=0-2.

Particularly interesting compounds are those of formulae:

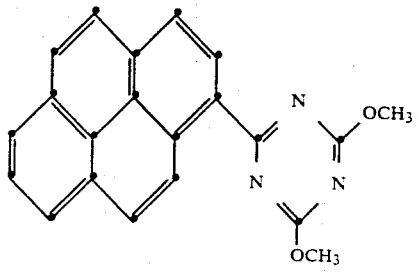

(7)

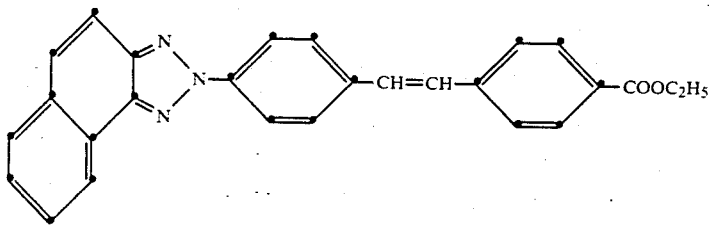

(8)

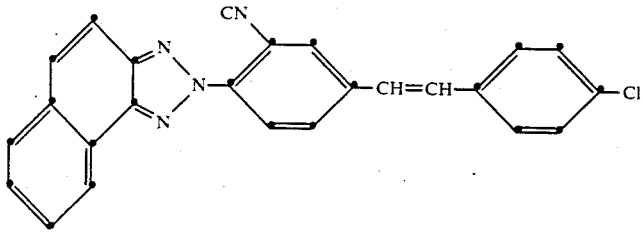

(9)

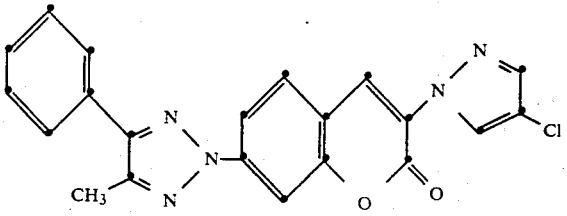

(10)

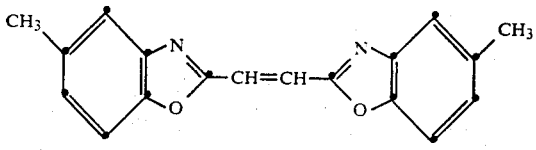

(11)

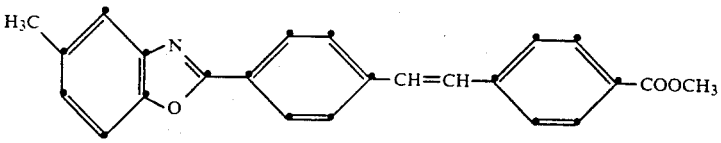

(12)

-continued
(13)
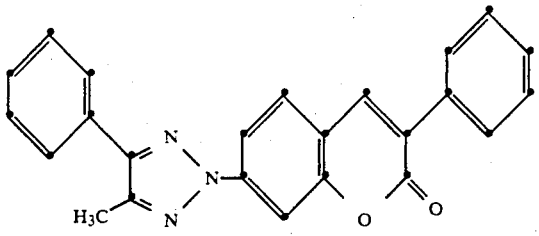
(14)
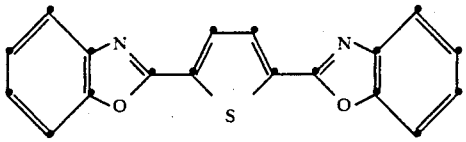
(15)
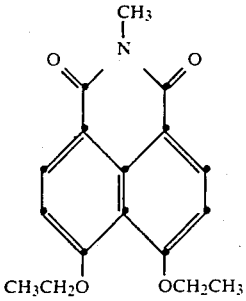
(16)
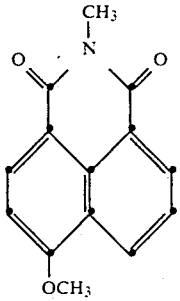
(17)
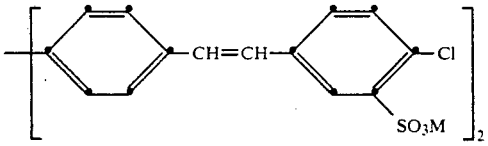
wherein M = Li, Na, K
(18)
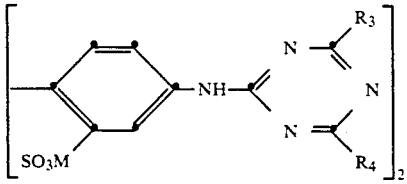
wherein
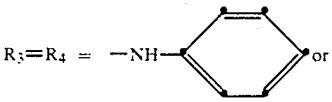
-continued
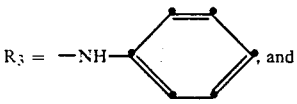
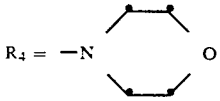
and M = Li, Na, K or ammonium as well as the mixtures I to VI:

I
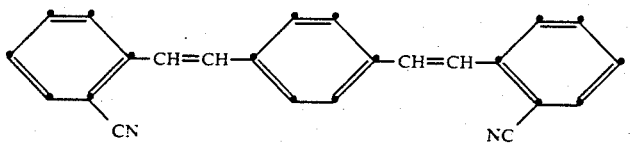
80%
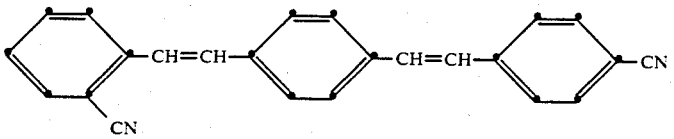
20%
II
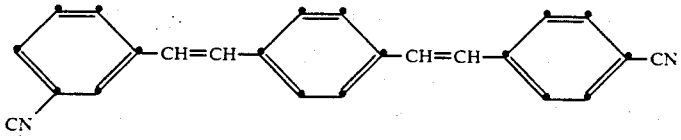
80%
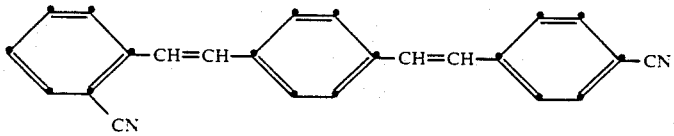
20%
III
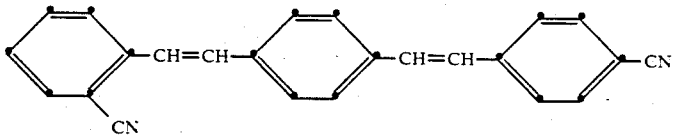
27%
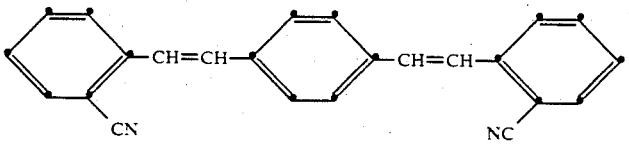
13%
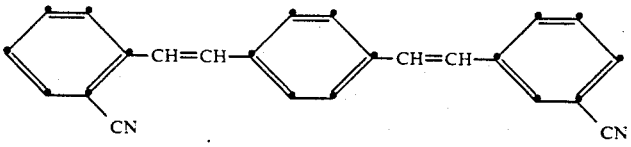
60%
IV
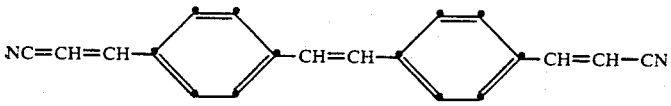
20% or 40%
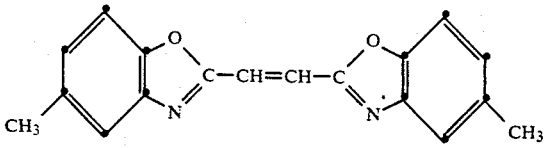
80% or 60%
V
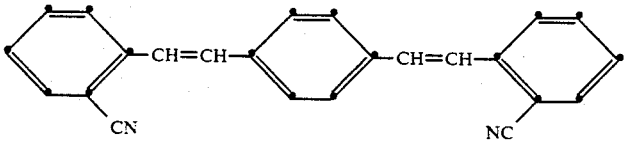
40%

-continued

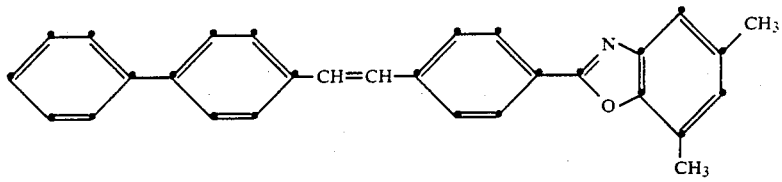

60%

VI

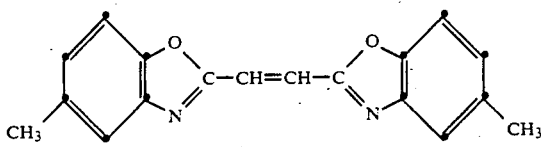

85%

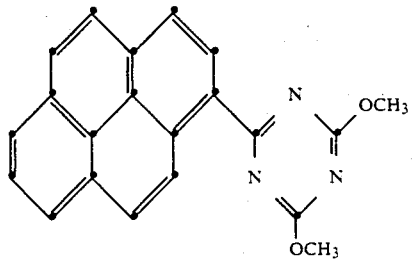

15%

The water-soluble fluorescent whitening agents are compounds or mixtures of compounds of the class, for example, of the bis(triazinyl)diaminostilbenes, distyrylbiphenyls and triazolylstilbenes, such as the compounds of formulae

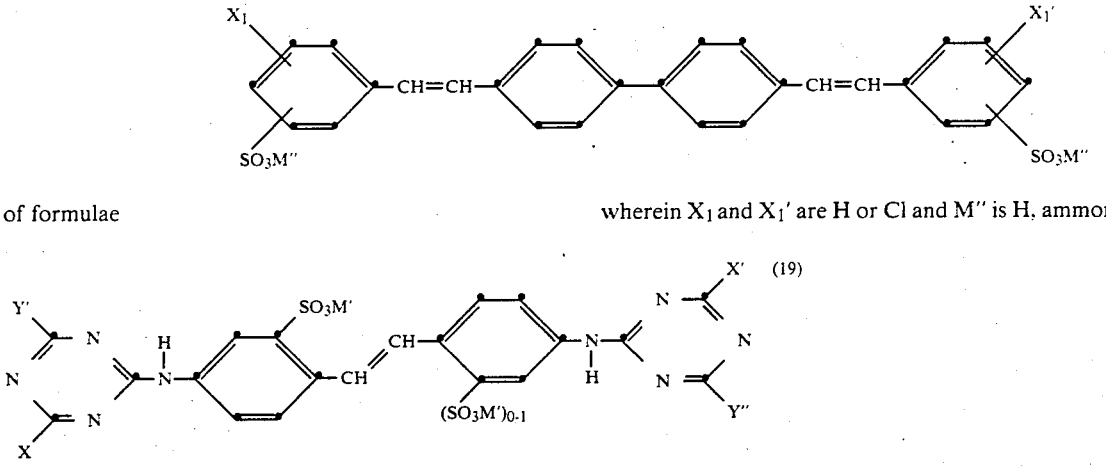

(19)

wherein X and X' are aniline, aniline-3-sulfonic acid, aniline-4-sulfonic acid, aniline-2,5-disulfonic acid or salts thereof or methanol, Y' and Y'' are aniline, ethanolamine, diethanolamine, N-methylethanolamine, diisopropanolamine, ethylamine, diethylamine, morpholine, diethylene glycol, propylene glycol, aminoethanesulfonic acid or salts thereof, ethanolaminopropionamide, cyanoethylbenzylamine, cyanoethylethanolamine, M' is H, Li, Na, K, ammonium or $C_1$–$C_4$alkylammonium; or $C_1$–$C_4$alkylammonium and, where appropriate, Li, Na or K;

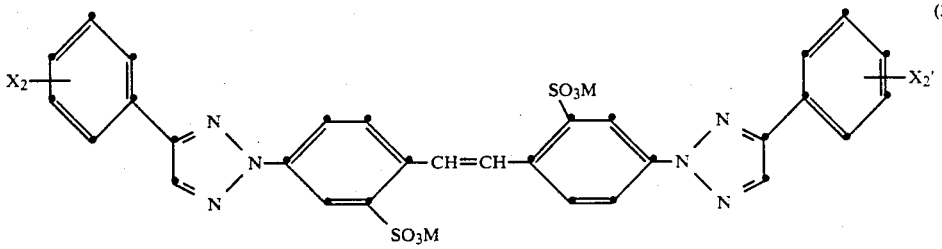

(20)

wherein $X_1$ and $X_1'$ are H or Cl and M'' is H, ammonium (21)

wherein $X_2$ and $X_2'$ are H, $SO_3M$ and M is Li, Na, K, ammonium or $C_1$–$C_4$alkylammonium.

Especially preferred are combinations of compounds of formula (19) with compounds of formula (3) and/or (5), as well as with the mixtures II, III, V and/or VI.

The ratio of water-soluble to water-insoluble or sparingly soluble fluorescent whitening agents is governed by the ratio of polyester:cellulose of the polyester/cellulose blends to be whitened. In general, 0.15–0.25% of water-soluble fluorescent whitening agent per 100% of cellulose, and 0.15–0.25% of water-insoluble or sparingly soluble fluorescent whitening agent per 100% of polyester, will be used.

The cationic, anionic and/or non-ionic dispersants are the customary dispersants for water-insoluble or sparingly soluble fluorescent whitening agents.

Examples of anionic suitable dispersants are condensates of aromatic sulfonic acids with formaldehyde as well as ligninsulfonates. Particularly suitable anionic dispersants are condensates of formaldehyde with naphthalenesulfonic acid as well as dihexylsulfosuccinates.

Suitable cationic dispersants are, for example, quaternary fatty amine polyglycol ethers.

It is preferred, however, to use non-ionic dispersants, for example: ethylene oxide adducts of the class of adducts of ethylene oxide with higher fatty acids, saturated or unsaturated fatty alcohols, mercaptans, fatty acid amides, fatty acid alkylolamides or fatty amines, or with alkylphenols or alkylthiophenols in which the alkyl moiety contains at least 7 carbon atoms, which adducts contain preferably 5 to 100 mol of ethylene oxide per 1 mol of the cited compounds, as well as block polymers of ethylene oxide and propylene oxide. Individual ethylene oxide units can be replaced by other epoxides, for example styrene oxide or, preferably, propylene oxide.

Representative individual ethylene oxide adducts are:

a) adducts of saturated and/or unsaturated $C_8$–$C_{20}$fatty alcohols with 5 to 100 mol of ethylene oxide per mol of alcohol, preferably of saturated linear $C_{16}$–$C_{18}$alcohols with 10 to 80 mol, preferably 25 mol, of ethylene oxide per mol of alcohol;

b) adducts of saturated and/or unsaturated $C_8$–$C_{20}$fatty acids with 5 to 20 mol of ethylene oxide per mol of acid, preferably ethoxylated castor oil;

c) adducts of alkylphenols containing 7 to 12 carbon atoms in the alkyl moiety with 5 to 25 mol of ethylene oxide per mol of phenolic hydroxy group, preferably of mono- or dialkylphenols with 10 to 20 mol of ethylene oxide per mol of phenolic hydroxy group;

d) adducts of saturated and/or unsaturated $C_8$–$C_{20}$fatty acid amides with 5 to 20 mol of ethylene oxide per mol of acid amide, preferably of oleylamides with 8 to 15 mol of ethylene oxide per mol of acid amide;

e) adducts of saturated and/or unsaturated $C_8$–$C_{20}$fatty amines with 5 to 20 mol of ethylene oxide per mol of amine, preferably of oleylamines with 8 to 15 mol of ethylene oxide per mol of amine;

f) block polymers of ethylene oxide and propylene oxide with 10–80% of ethylene oxide and having molecular weights of 1000 to 80 000;

g) polyadducts of ethylene oxide and propylene oxide with ethylenediamine.

The adducts cited in a) to f) are preferred. It is also possible to use mixtures of the adducts of a) to g) with one another.

By solubilisers, which are used especially for the water-soluble fluorescent whitening agents, are meant hydrotropic agents such as polyethylene glycols preferably having molecular weights in the range from 200 to 40 000, most preferably from 1000 to 6000, as well as urea, tetramethylurea, triethanolamine, diethylene glycol, propylene glycol, cumenesulfonates, xylenesulfonates and benzenesulfonates, monoethylene, diethylene and polyethylene glycol monoethyl and diethyl ester and monoethylene, diethylene and polyethylene glycol ether acetates.

It is further very advantageous that the dispersant as well as the solubiliser should be compatible with the whitener dispersion, i.e. that no precipitation results and that homogeneous dispersions are obtained.

The dispersion of this invention may also contain further assistants, for example textile auxilaries, shading dyes, foam inhibitors and, especially, anti-freeze agents such as polyols, preferably di- or polyalcohols such as ethylene glycol, propylene glycol, diethylene glycol, glycerol and/or sorbitol, humectants, surfactants, for example polyethylene glycols having molecular weights in the range from 200 to 6 000, and/or microbicides such as chloroacetamide or aqueous formaldehyde solutions, as well as fungicides.

The salient feature of the invention is that the whitener dispersion contains a copolymer of 2-vinylpyrrolidone and 3-vinylpropionic acid. Such copolymers are known and can be prepared by known methods.

A particularly preferred whitener dispersion comprises 5–10% of water-insoluble or sparingly soluble fluorescent whitening agent of the class of the bis(benzoxozolyl)thiophenes, 4–10% of water-soluble fluorescent whitening agent of the class of the bis(triazinyl)-diaminostilbenedisulfonic acids, 2–5% of ethoxylated $C_{16}$–$C_{18}$fatty alcohol or ethylene oxide/propylene oxide block polymer as dispersant, 3–6% of copolymer of 2-vinylpyrrolidone and 3-vinylpropionic acid, and 14–16% of polyethylene glycol or 10–25% of urea as solubiliser, 0–0.5% of shading dye and 0.1–0.5% of formaldehyde as further assistants.

The whitener dispersion of this invention is prepared, for example, a) by mixing the separately prepared and formulated individual components—the separately formulated water-insoluble or sparingly soluble fluorescent whitening agent and the separately formulated water-soluble fluorescent whitening agent are preferably mixed—or b) by jointly formulating the individual components, for example by grinding in a microsol mill, bead mill, sand mill or dynomill to a particle size smaller than 5 μm.

The novel dispersions are used in particular for whitening polyester/cellulose fibre material, preferably polyester/cotton fabric, by applying said dispersions by a single step method to the material. In this context, "single step" means that the water-insoluble or sparingly soluble fluorescent whitening agent is applied simultaneously with the water-soluble fluorescent whitening agent. Application is made preferably by the exhaust process or also by the pad process, in weakly acid to strongly alkaline medium. A particular advantage of this process is that the polyester component and the cellulose component of the material are simultaneously whitened.

The invention is illustrated by the following non-limitative Examples, in which parts and percentages are by weight.

EXAMPLE 1

15 parts of a mixture of 60% of the sparingly soluble fluorescent whitening agent of formula and 57% of the water-soluble fluorescent whitening agent of formula

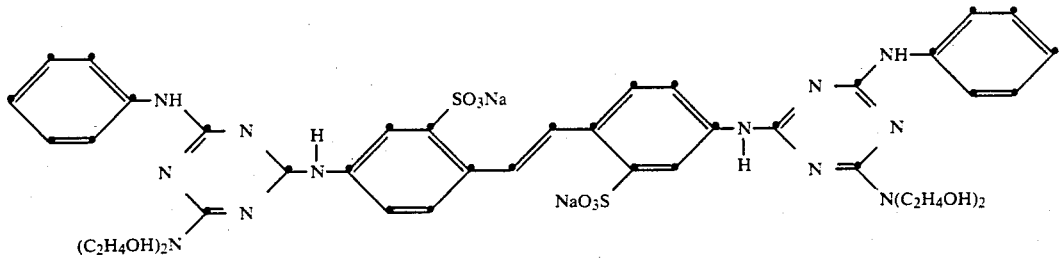

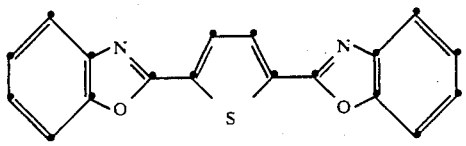

and 40% of the water-soluble fluorescent whitening agent of formula

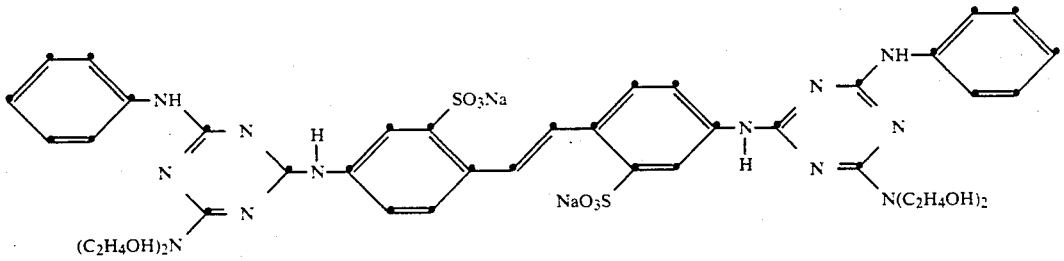

2.0 parts of the adduct of a $C_{16}$–$C_{18}$fatty alcohol with 25 mol of ethylene oxide,
15.0 parts of polyethylene glycol 4000,
0.3 part of an anthraquinone dye,
0.5 part of 37% formaldehyde,
14.0 parts of a 30% aqueous copolymer of 2-vinylpyrrolidone and 3-vinylpropionic acid, and
53.2 parts of water are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 2

18 parts of a mixture of 43% of the sparingly soluble fluorescent whitening agent of formula

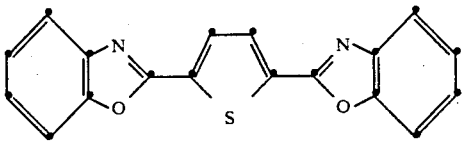

2.0 parts of the adduct of a $C_{16}$–$C_{18}$fatty alcohol with 25 mol of ethylene oxide,
20.0 parts of polyethylene glycol 4000,
0.5 part of 37% formaldehyde,
10.0 parts of a 30% aqueous copolymer of 2-vinylpyrrolidone and 3-vinylpropionic acid, and
49.5 parts of water are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 3

15 parts of a mixture of 60% of the sparingly soluble fluorescent whitening agent of formula

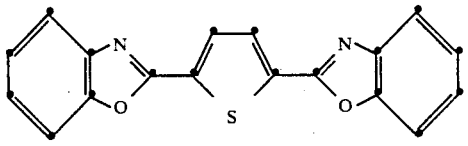

and 40% of the water-soluble fluorescent whitening agent of formula

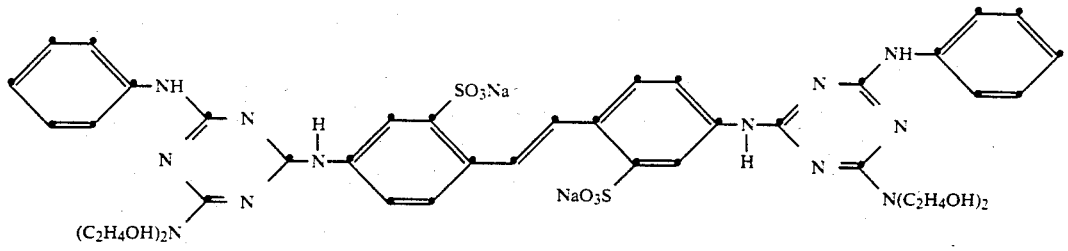

2.0 parts of an ethylene oxide/propylene oxide block polymer with 80% of ethylene oxide and having a molecular weight of ca. 16 000,
15.0 parts of urea,
0.3 part of an anthraquinone dye,
0.5 part of 37% formaldehyde,
14.0 parts of a 30% aqueous copolymer of 2-vinylpyrrolidone and 3-vinylpropionic acid, and
53.2 parts of water are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 4

15 parts of a mixture of 60% of the sparingly soluble fluorescent whitening agent of formula

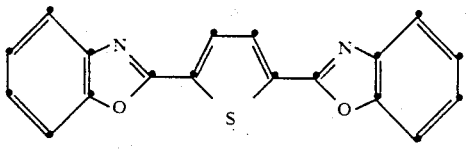

and 40% of the water-soluble fluorescent whitening agent of formula 2 parts of an ethylene oxide/propylene oxide block polymer with 10% of ethylene oxide and having a molecular weight of ca. 1060,
15 parts of urea,
0.3 part of an anthraquinone dye,
0.5 part of 37% formaldehyde,
14 parts of a 30% aqueous copolymer of 2-vinylpyrrolidone and 3-vinylpropionic acid, and
53.2 parts of water are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 5

15 parts of a mixture of 60% of the sparingly soluble fluorescent whitening agent of formula

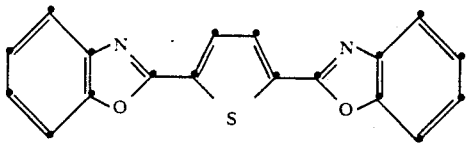

and 40% of the water-soluble fluorescent whitening agent of formula

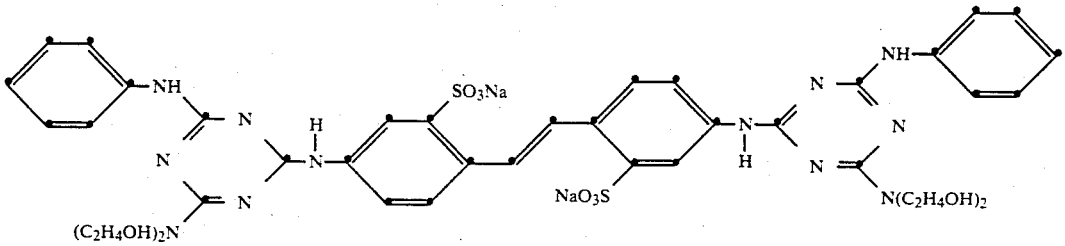

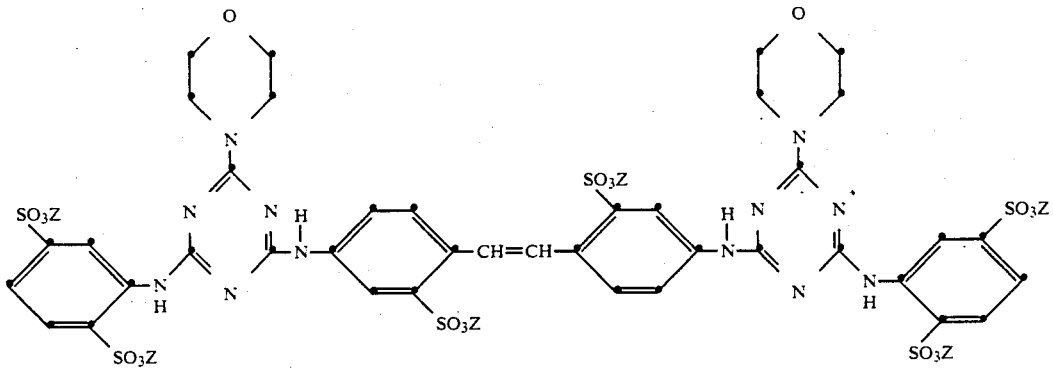

Z = Na, diethanolamine (2:1)

2 parts of an adduct of a $C_{16}$–$C_{18}$ fatty alcohol with 25 mol of ethylene oxide,
15 parts of polyethylene glycol 5–6000,
3.3 parts of ethylene glycol,
0.5 part of 37% formaldehyde,
14 parts of a 30% aqueous copolymer of 2-vinylpyrrolidone and 3-vinylpropionic acid, and
50.2 parts of water are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 6

9.20 parts of the sparingly soluble fluorescent whitening agent of formula

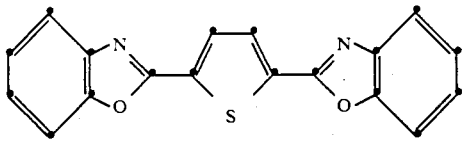

(active content 98%)

and 6.64 of the water-soluble fluorescent whitening agent of formula 2 parts of the adduct of a $C_{16}$–$C_{18}$ fatty alcohol with 25 mol of ethylene oxide,
15 parts of polyethylene glycol 4000,
0.5 part of 37% formaldehyde,
14.0 parts of a 30% aqueous copolymer of 2-vinylpyrrolidone and 3-vinylpropionic acid, and
52.36 parts of water, are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 7

7.9 parts of the sparingly soluble fluorescent whitening agent of formula

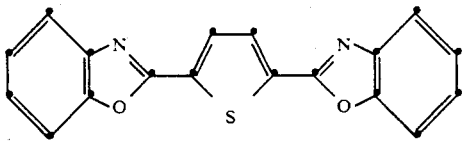

(active content 98%)

and 11.4 parts of the water-soluble fluorescent whitening agent of formula

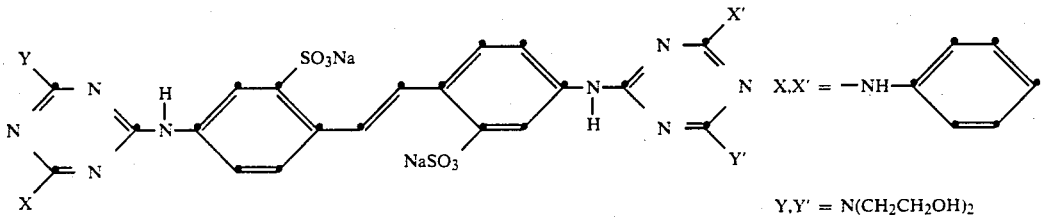

Y,Y' = $N(CH_2CH_2OH)_2$ (active content 90%)

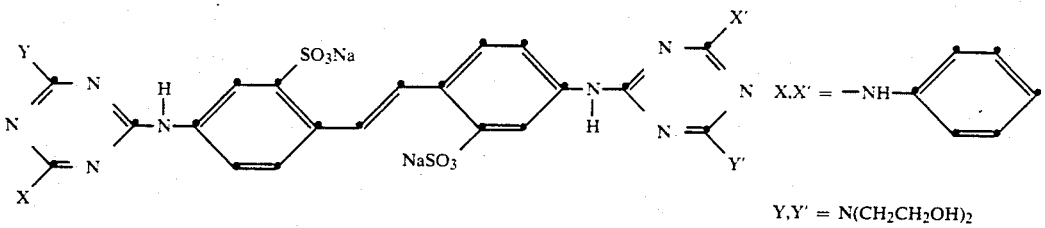

Y,Y' = $N(CH_2CH_2OH)_2$ (active content 90%)

2 parts of an adduct of a $C_{16}$–$C_{18}$ fatty alcohol and 25 mol of ethylene oxide,
20 parts of polyethylene glycol 4000,
0.2 part of chloroacetamide,
10 parts of a 30% aqeous copolymer of 2-vinylpyrrolidone and 3-vinylpropionic acid, and
48.5 parts of water are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 8

9.20 parts of the sparingly soluble fluorescent whitening agent of formula

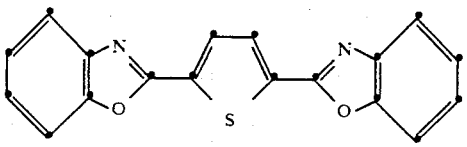

(active content 98%)

and 6.64 parts of the water-soluble fluorescent whitening agent of formula

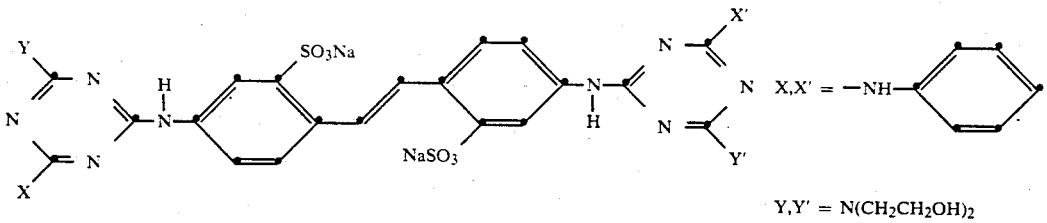

Y,Y' = $N(CH_2CH_2OH)_2$ (active content 90%)

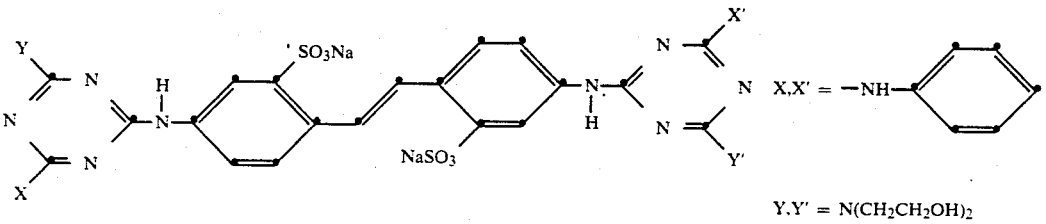

Y,Y' = $N(CH_2CH_2OH)_2$ (active content 90%)

2.0 parts of an adduct of a $C_{16}$–$C_{18}$ fatty alcohol and 25 mol of ethylene oxide,
15.0 parts of polyethylene glycol 4000,
0.2 part of chloroacetamide,
14.0 parts of a 30% aqueous copolymer of 2-vinylpyrrolidone and 3-vinylpropionic acid, and
52.96 parts of water are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 9

9.20 parts of the sparingly soluble fluorescent whitening agent of formula

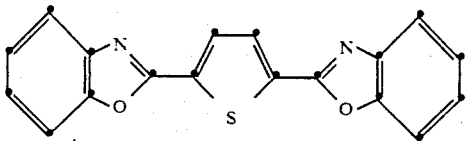

(active content 98%)

and 6.64 parts of the water-soluble fluorescent whitening agent of formula 2.0 parts of an ethylen oxide/propylene oxide block polymer with 80% of ethylene oxide and having a molecular weight of ca. 16 000, 15.0 parts of urea, 0.2 part of chloroacetamide, 14.0 parts of a 30% aqueous copolymer of 2-vinylpyrrolidone and 3-vinylpropionic acid, and 52.96 parts of water are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 10

9.20 parts of the sparingly soluble fluorescent whitening agent of formula

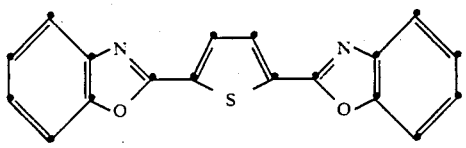

(active content 98%)

and 6.64 parts of the water-soluble fluorescent whitening agent of formula

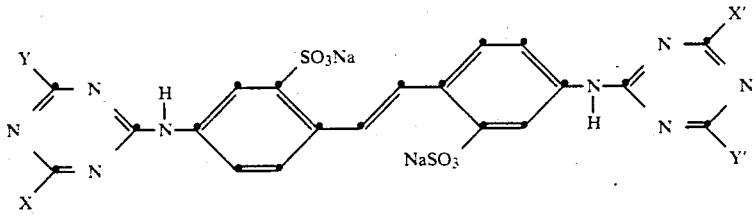

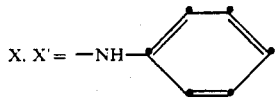

Y, Y' = $N(CH_2CH_2OH)_2$
(active content 90%)

2.0 parts of an ethylene oxide/propylene oxide block polymer with 80% of ethylene oxide and having a molecular weight of ca. 1060, 15.0 parts of urea, 0.2 parts of chloroacetamide, 14.0 parts of a 30% aqueous copolymer of 2-vinylpyrrolidone and 3-vinylpropionic acid, and 52.96 parts of water are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 11

5.30 parts of the sparingly soluble fluorescent whitening agent of formula

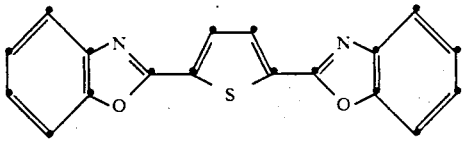

(active content 98%)

and 13.24 parts of the water-soluble fluorescent whitening agent of formula

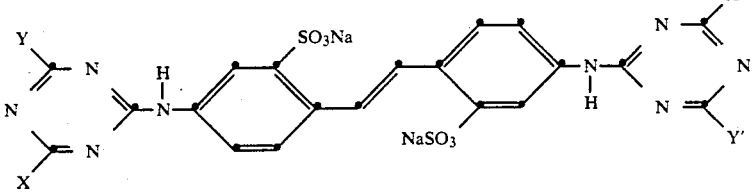

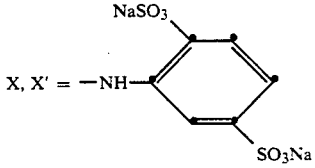

-continued (active content 74%)

2.0 parts of the adduct of a $C_{16}$–$C_{18}$fatty alcohol with 25 mol of ethylene oxide,
20.0 parts of polyethylene glycol 4000,
0.2 part of chloroacetamide,
14.0 parts of a 30% aqueous copolymer of 2-vinylpyrrolidone and 3-vinylpropionic acid, and
54.74 parts of water are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 12

8.16 parts of the sparingly soluble fluorescent whitening agent of formula

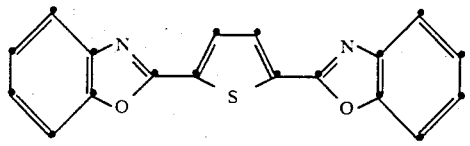

(active content 98%)

and 8.97 parts of the water-soluble fluorescent whitening agent of formula

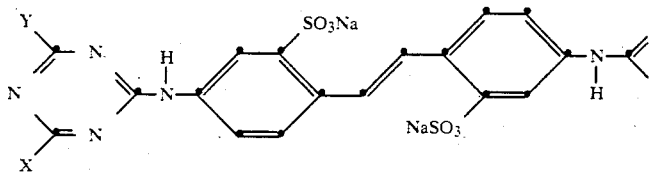

X, X' = —NH— 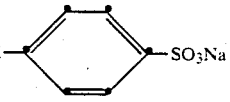

Y, Y' = NH—$CH_2CH_2OH$
(active content 78%)

2.0 parts of the adduct of a $C_{16}$–$C_{18}$fatty alcohol with 25 mol of ethylene oxide,
20.0 parts of polyethylene glycol 4000,
0.2 part of chloroacetamide,
14.0 parts of a 30% aqueous copolymer of 2-vinylpyrrolidone and 3-vinylpropionic acid, and
46.47 parts of water are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 13

8.25 parts of the sparingly soluble fluorescent whitening agent of formula

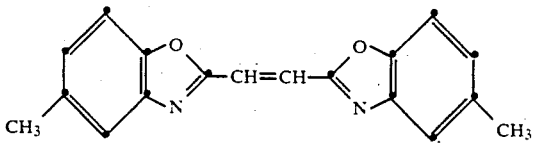

(active content 100%)

1.45 parts of the sparingly soluble fluorescent whitening agent of formula

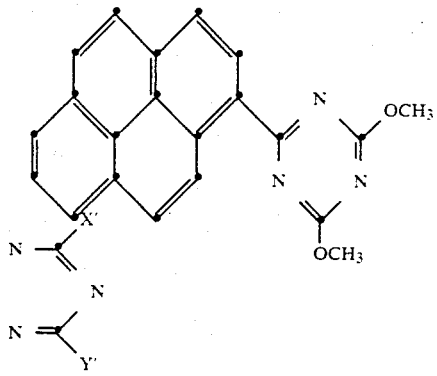

(active content 100%)

5.90 parts of the water-soluble fluorescent whitening agent of formula

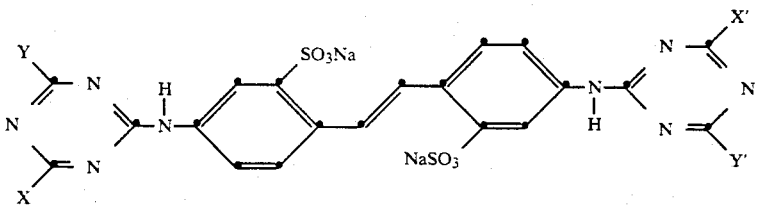

-continued

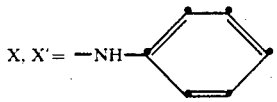

Y, Y' = $N(CH_2CH_2OH)_2$
(active content 90%)

2.0 parts of the adduct of a $C_{16}$–$C_{18}$ fatty alcohol with 25 mol of ethylene oxide,
2.5 parts of 1,2-propylene glycol,
0.5 part of a modified aldehyde/ketone condensation resin,
16.0 parts of polyethylene glycol 4000,
0.2 part of chloroacetamide,
14.0 parts of a 30% aqueous copolymer of 2-vinylpyrrolidone and 3-vinylpropionic acid, and
49.26 parts of water, are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 14

8.08 parts of the sparingly soluble fluorescent whitening agent of formula

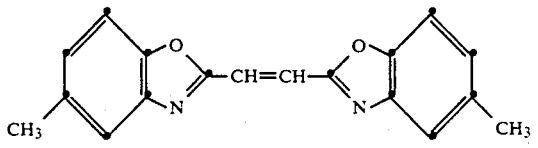

(active content 100%)

1.42 parts of the sparingly soluble fluorescent whitening agent of formula

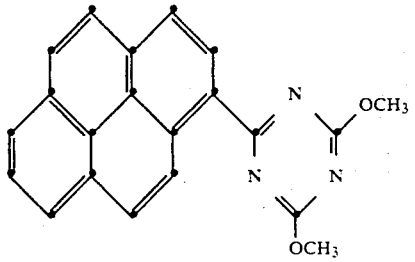

(active content 100%)

7.05 parts of the water-soluble fluorescent whitening agent of formula

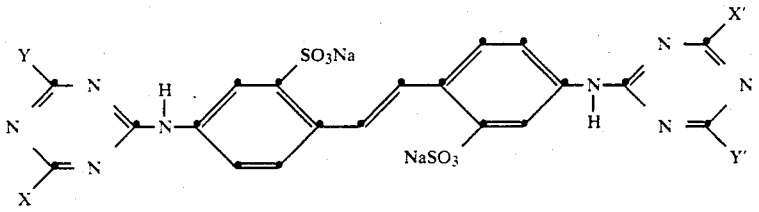

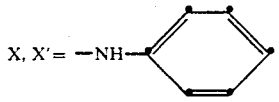

Y, Y' = $N(CH_2CH_2OH)_2$
(active content 90%)

2.0 parts of the adduct of a $C_{16}$–$C_{18}$ fatty alcohol with 25 mol of ethylene oxide,
2.5 parts of 1,2-propylene glycol,
0.5 part of a modified aldehyde/ketone condensation resin,
8.0 parts of polyethylene glycol 4000,
0.2 part of chloroacetamide,
14.0 parts of a 30% aqueous copolymer of 2-vinylpyrrolidone and 3-vinylpropionic acid, and
56.25 parts of water, are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage stable for several months at room temperature as well as at 40° C.

EXAMPLE 15

5.7 parts of the sparingly soluble fluorescent whitening agent of formula

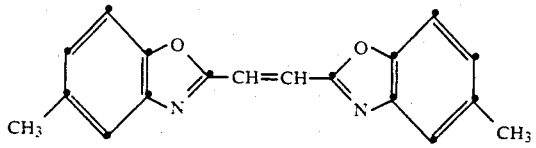

(active content 100%)

1.0 part of the sparingly soluble fluorescent whitening agent of formula

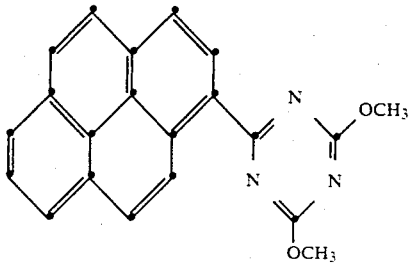

(active content 100%)

11.2 parts of the water-soluble fluorescent whitening agent of formula

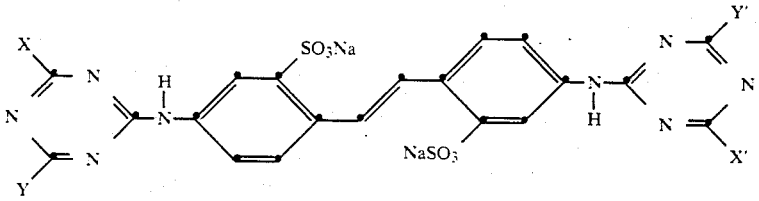

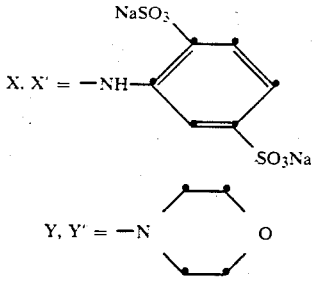

(active content 74%)

2.0 parts of the adduct of a $C_{16}$–$C_{18}$ fatty alcohol with 25 mol of ethylene oxide,
1.75 parts of 1,2-propylene glycol,
0.35 part of a modified aldehyde/ketone condensation resin,
15.0 parts of polyethylene glycol,
0.2 part of chloroacetamide,
14.0 parts of a 30% aqueous copolymer of 2-vinylpyrrolidone and 3-vinylpropionic acid, and
48.8 parts of water, are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 16

8.08 parts of the sparingly soluble fluorescent whitening agent of formula

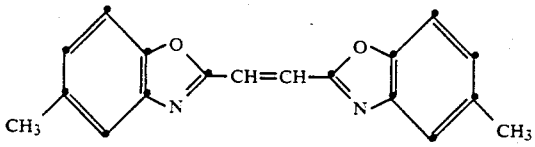

(active content 100%)

1.42 parts of the sparingly soluble fluorescent whitening agent of formula

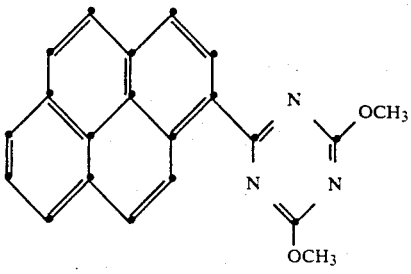

(active content 100%)

6.25 parts of the water-soluble fluorescent whitening agent of formula

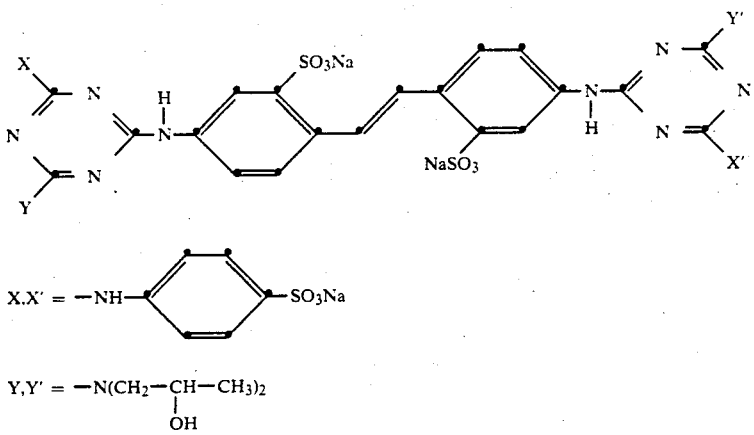

(active content 88%)

2.0 parts of an adduct of a $C_{16}$–$C_{18}$fatty alcohol and 25 mol of ethylene oxide,
2.5 parts of 1,2-propylene glycol,
0.5 part of a modified aldehyde/ketone condensation resin,
0.2 part of chloroacetamide,
14.0 parts of a 30% aqueous copolymer of 2-vinylpyrrolidone and 3-vinylpropionic acid, and
65.05 parts of water, are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage-stable for several months at room temperature as well as at 40° C.

EXAMPLE 17

4.64 parts of the sparingly soluble fluorescent whitening agent of formula

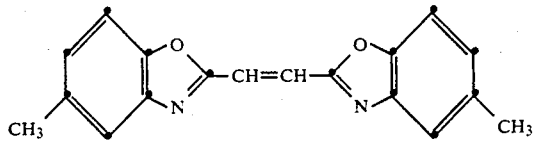

-continued
(active content 100%)

0.82 part of the sparingly soluble fluorescent whitening agent of formula

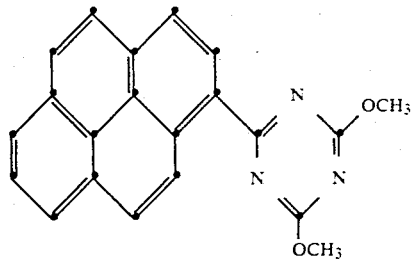

(active content 100%)

6.25 parts of the water-soluble fluorescent whitening agent of formula

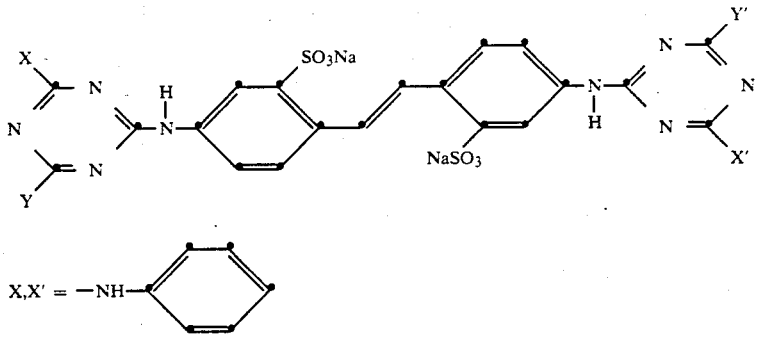

(active content 88.5%)

2.0 parts of the adduct of a $C_{16}$–$C_{18}$fatty alcohol with 25 mol of ethylene oxide,
1.4 parts of 1,2-propylene glycol,
0.3 part of a modified aldehyde/ketone condensation resin,
50.0 parts of triethanolamine,
0.2 part of chloroacetamide, 14.0 parts of a 30% aqueous copolymer of 2-vinylpyrrolidone and 3-vinylpropionic acid, and 20.4 parts of water, are ground in a stirred ball mill with glass beads until the dispersion has a particle size of less than 2 μm. The glass beads are then separated, affording a homogeneous, readily pourable and pumpable liquid formulation having a 15% content of fluorescent whitening agent. The dispersion is storage stable for several months at room temperature as well as at 40° C.

EXAMPLE 18

9.2 parts of the sparingly soluble fluorescent whitening agent of formula

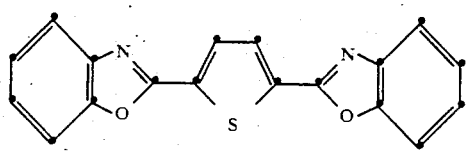

(active content 98%)

9.0 parts of the sparingly soluble fluorescent whitening agent of formula

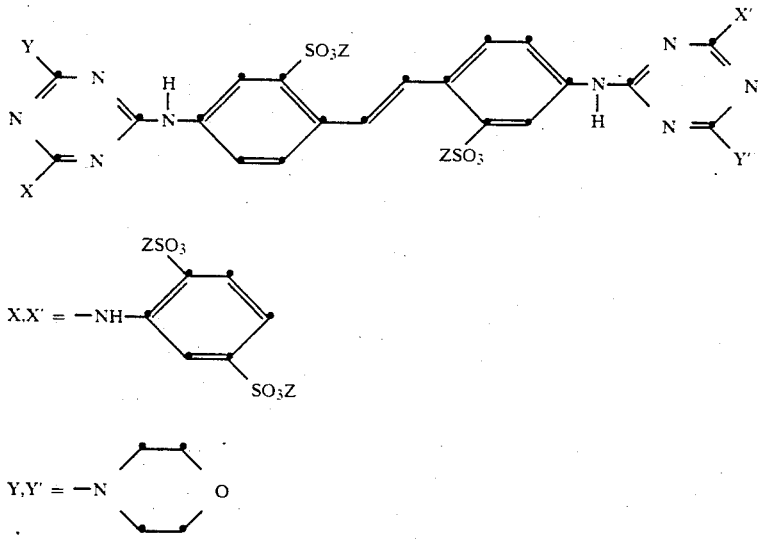

(active content 74%)

Z = 2:1 Na, diethanolammonium 2.0 parts of the adduct of a $C_{16}$–$C_{18}$fatty alcohol with 25 mol of ethylene oxide, 0.7 part of diethanolamine, 3.3 parts of ethylene glycol, 15.0 parts of polyethylene glycol 5000–6000, 0.2 part of chloroacetamide, 14.0 parts of a 30% aqueous copolymer of 2-vinylpyrrolidone and 3-vinylpropionic acid, and 46.6 parts of water, are ground in a stirred ball mill with glass beads until the dispersion has a particle size of less than 2 μm. The glass beads are then separated, affording a homogeneous, readily pourable and pumpable liquid formulation having a 15.6% content of fluorescent whitening agent. The dispersion is storage-stable for several months at room temperature as well as at 40° C.

EXAMPLE 19

4.24 parts of the sparingly soluble fluorescent whitening agent of formula

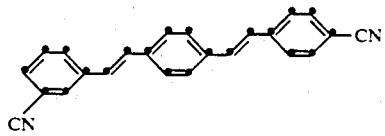

(active content 100%)

1.06 parts of the sparingly soluble fluorescent whitening agent of formula

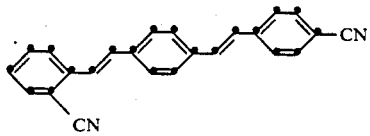

(active content 100%)

5.2 parts of the sparingly soluble fluorescent whitening agent of formula

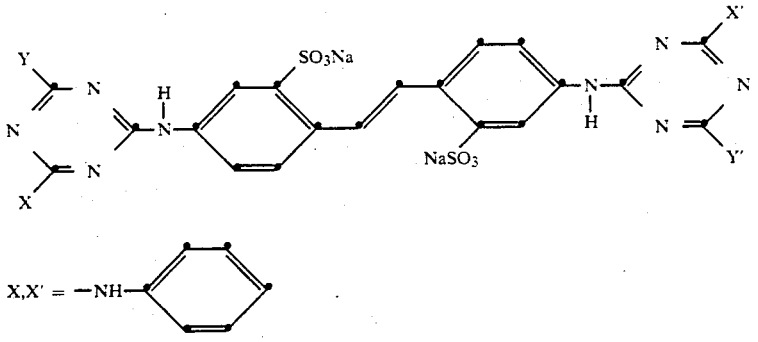

X,X' = —NH—

Y',Y' = —N(CH$_2$CH$_2$OH)$_2$ (active content 90%)

2.0 parts of the adduct of a $C_{16}$–$C_{18}$fatty alcohol with 25 mol of ethylene oxide,
12.0 parts of polyethylene glycol 4000,
0.2 part of chloroacetamide,
14.0 parts of a 30% aqueous copolymer of 2-vinylpyrrolidone and 3-vinyl propionic acid, and
61.3 parts of water, are ground in a stirred ball mill with glass beads until the dispersion has a particle size of less than 2 μm. The glass beads are then separated, affording a homogeneous, readily pourable and pumpable liquid formulation having a 10% content of fluorescent whitening agent. The dispersion is storage-stable for several months at room temperature as well as at 40° C.

EXAMPLE 20

2.68 parts of the sparingly soluble fluorescent whitening agent of formula

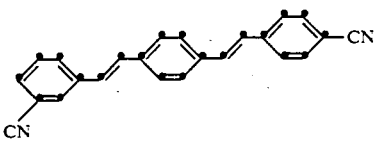

-continued (active content 100%)

0.67 part of the sparingly soluble fluorescent whitening agent of formula

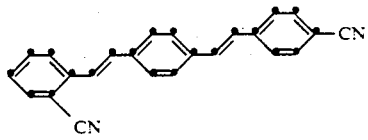

(active content 100%)

9.0 parts of the sparingly soluble fluorescent whitening agent of formula

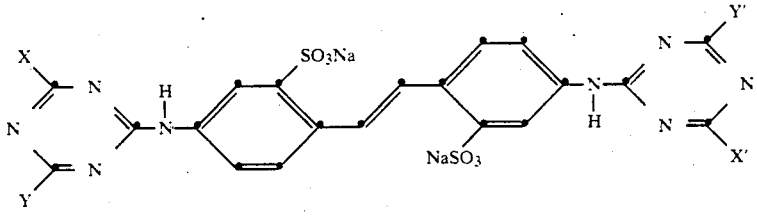

X,X' = —NH—

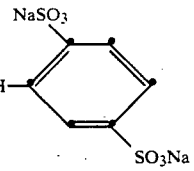

Y,Y' = —N

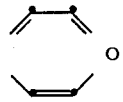

(active content 74%)

2.0 parts of the adduct of a $C_{16}$–$C_{18}$fatty alcohol with 25 mol of ethylene oxide,
12.0 parts of polyethylene glycol 4000,
0.2 part of chloroacetamide,
14.0 parts of a 30% aqueous copolymer of 2-vinylpyrrolidone and 3-vinyl propionic acid, and 59.45 parts of water, are ground in a stirred ball mill with glass beads until the dispersion has a particle size of less than 2 μm. The glass beads are then separated, affording a homogeneous, readily pourable and pumpable liquid formulation having a 10% content of fluorescent whitening agent. The dispersion is storage-stable for several months at room temperature as well as at 40° C.

EXAMPLE 21

4.24 parts of the sparingly soluble fluorescent whitening agent of formula

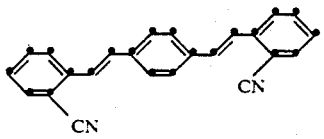

(active content 100%)

1.06 parts of the sparingly soluble fluorescent whitening agent of formula

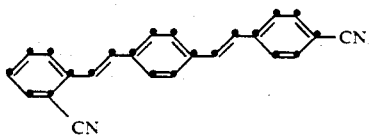

(active content 100%)

5.2 parts of the sparingly soluble fluorescent whitening agent of formula

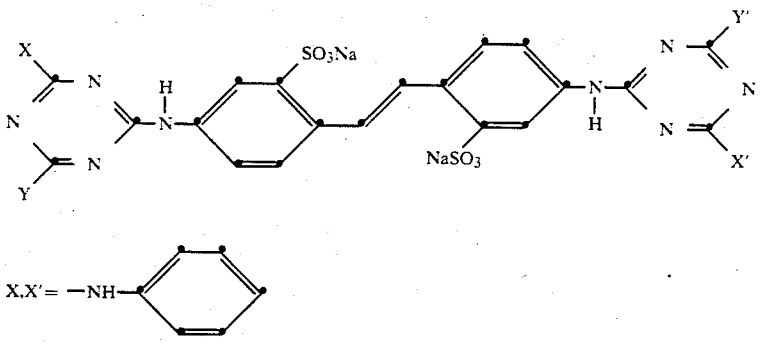

Y,Y'= $N(CH_2CH_2OH)_2$
(active content 90%)

2.0 parts of the adduct of a $C_{16}$–$C_{18}$fatty alcohol with 25 mol of ethylene oxide,
12.0 parts of polyethylene glycol 4000,
0.2 part of chloroacetamide,
14.0 parts of a 30% aqueous copolymer of 2-vinylpyrrolidone and 3-vinyl propionic acid, and
61.3 parts of water, are ground in a stirred ball mill with glass beads until the dispersion has a particle size of less than 2 μm. The glass beads are then separated, affording a homogeneous, readily pourable and pumpable liquid formulation having a 10% content of fluorescent whitening agent. The dispersion is storage-stable for several months at room temperature as well as at 40° C.

EXAMPLE 22

1 g of the whitener dispersion according to any one of Examples 1–21 is predispersed in 10 ml of warm water of 40° C. that contains 1 g/l of a non-ionic dispersant (Irgasol NA). This preliminary dispersion is added to the warm whitener bath of 40° C. that contains 100 g of prebleached polyester/cellulose fabric (50:50) and 1 g/l of a non-ionic dispersant (Irgasol NA). After a 10 minute preliminary running of the goods, the bath is heated to 110° C. over 30 minutes. The goods are left in the bath for a further 40 minutes at this temperature. The bath is then cooled and the goods are rinsed and dried, to give a uniformly whitened fabric with a high degree of whiteness.

EXAMPLE 23

A whitener dispersion according to any one of Examples 1 to 4 and 6 to 21 is predispersed as in Example 22. This preliminary dispersion is added to the warm whitener bath of 40° C. that contains 100 g of polyester/cellulose fabric (50:50), 1 g/l of a non-ionic dispersant (Irgasol NA) and the chemicals necessary for bleaching the fabric (5 ml/l of $H_2O_2$, 35% by weight, 0.5 ml/l of diethylenetriaminopentacetic acid and 1 g/l of 100% NaOH). Application is made as in Example 22, to give a uniformly whitened and bleached fabric with a high degree of whiteness.

What is claimed is:

1. An aqueous dispersion comprising at least one water-insoluble or sparingly soluble fluorescent whitening agent, at least one water-soluble fluorescent whitening agent, an optional solubiliser, at least one anionic, cationic or non-ionic dispersant and further optional assistants, which dispersion additionally comprises a copolymer of 2-vinylpyrrolidone and 3-vinylpropionic acid.

2. A dispersion according to claim 1, which comprises 3–20% of water-insoluble or sparingly soluble fluorescent whitening agent, 4–20% of water-soluble fluorescent whitening agent, 2–20% of dispersant, 5–25% of solubiliser, 1–20% of copolymer of 2-vinylpyrrolidone and 3-vinylpropionic acid, and 0.1–10% of further assistants.

3. A dispersion according to claim 2, which comprises 5–10% of water-insoluble or sparingly soluble fluorescent whitening agent, 4–10% of water-soluble fluorescent whitening agent, 2–5% of dispersant, 10–25% of solubiliser, 3–6% of copolymer of 2-vinylpyrrolidone and 3-vinylpropionic acid, and 0.1–5% of further assistants.

4. A dispersion according to claim 1, wherein the water-insoluble or sparingly soluble fluorescent whitening agents are compounds or mixtures of compounds selected from the group consisting of the class of the stilbenes, distyrylbenzenes, distyrylbiphenyls, triazinyls, benzoxazoles, bis(benzoxazoles), bis(benzoxazolyl)thiophenes, bis(benzoxazolyl)naphthalenes, pyrenes, coumarins and naphthalene-peridicarboximides, and the water-soluble fluorescent whitening agents are compounds or mixtures of compounds selected from the class consisting of bis(triazinyl)diaminostilbenes, distyrylbiphenyls and triazolylstilbenes.

5. A dispersion according to claim 4, which contains at least one compound of formula

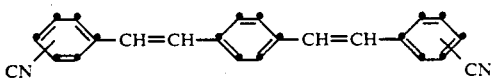

(1)

as water-insoluble or sparingly soluble fluorescent whitening agent.

6. A dispersion according to claim 4, which contains at least one compound of formula

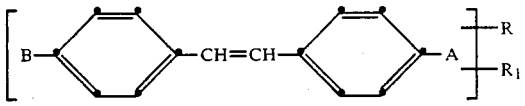

(2)

wherein

A = 2-benzoxazolyl, —CH=CH—CN, —CH=CH—$COOR_2$, —$COOR_2$ or halogen,

B = phenyl if A is 2-benzoxazolyl,

B = —CH=CH—CN if A is —CH=CH—CN,

B = —CH=CH—$COOR_2$ if A is —CH=CH—$COOR_2$,

B = naphthalene-triazolyl if A is halogen or —$COOR_2$,

B = 1,2,4-oxadiazole if A is 2-benzoxazolyl, and

R = H, $C_1$–$C_4$alkyl, $R_1$ = H, $C_1$–$C_4$alkyl and CN, $R_2$ = $C_1$–$C_4$alkyl, as water-insoluble or sparingly soluble fluorescent whitening agent.

7. A dispersion according to claim 4, wherein the water-insoluble or sparingly soluble fluorescent whitening agent is a compound of formula

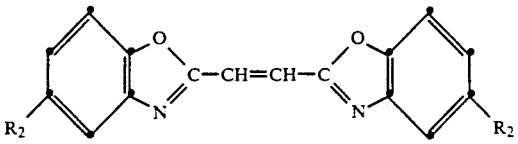

(3)

wherein $R_2$ is $C_1$–$C_4$alkyl.

8. A dispersion according to claim 4, wherein the water-insoluble or sparingly soluble fluorescent whitening agent is a compound of formula

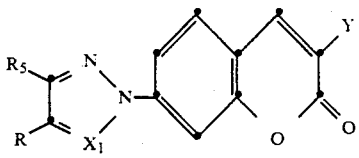

(4)

wherein $R_5$ is $C_1$–$C_4$alkyl or phenyl, and R is H or $C_1$–$C_4$alkyl, $X_1$ is C or N, and Y is phenyl or a radical of formula

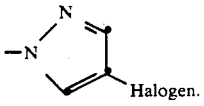

9. A dispersion according to claim 4, wherein the water-insoluble or sparingly soluble fluorescent whitening agent is a compound of formula

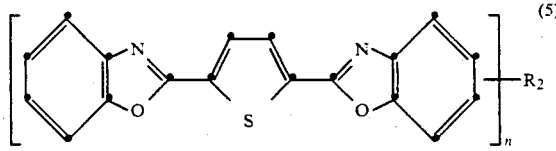

(5)

wherein n is 0 to 2 and $R_2$ is $C_1$–$C_4$alkyl.

10. A dispersion according to claim 4, wherein the water-insoluble or sparingly soluble fluorescent whitening agent is a compound of formula

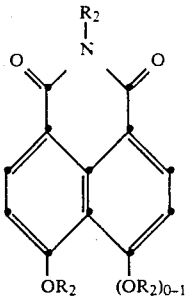

(6)

wherein $R_2$ is $C_1$–$C_4$alkyl.

11. A dispersion according to claim 4, wherein the water-insoluble or sparingly soluble fluorescent whitening agent is a compound of formula

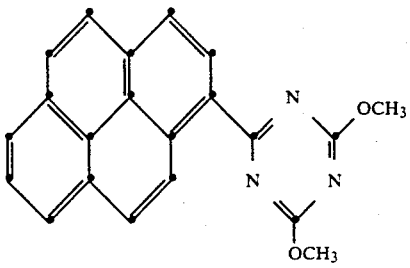

(7)

12. A dispersion according to claim 4, wherein the water-insoluble or sparingly soluble fluorescent whitening agent is a compound of formula

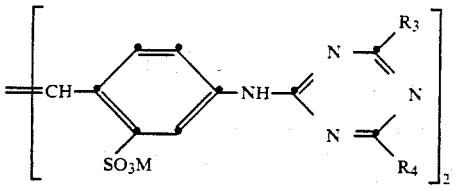

(18)

wherein $R_3 = R_4 =$ 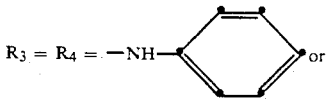 or $R_3 =$ 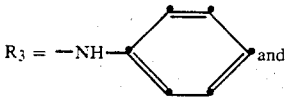 and $R_4 =$ 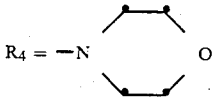

and M is Na, Li, K or ammonium.

13. A dispersion according to claim 4, wherein the water-insoluble or sparingly soluble fluorescent whitening agent is a compound of formula

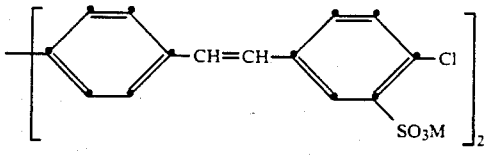

(17)

wherein M is Li, Na or K.

14. A dispersion according to claim 4, wherein the water-soluble fluorescent whitening agent is a compound of formula

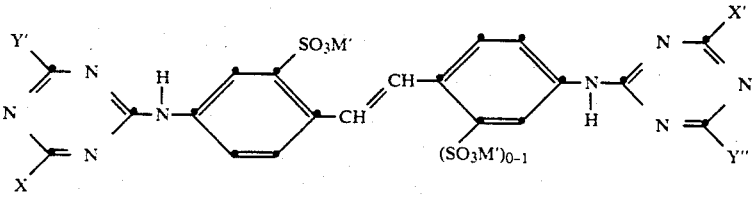

(19)

wherein X and X' are aniline, aniline-3-sulfonic acid, aniline-4-sulfonic acid, aniline-2,5-disulfonic acid or salts thereof or methanol, Y' and Y'' are aniline, ethanolamine, diethanolamine, N-methylethanolamine, diisopropanolamine, ethylamine, diethylamine, morpholine, diethylene glycol, propylene glycol, aminoethanesulfonic acid or salts thereof, ethanolaminopropionamide, cyanoethylbenzylamine, cyanoethylethanolamine, and M' is H, Li, Na, K, ammonium or $C_1$–$C_4$alkylammonium.

15. A dispersion according to claim 4, wherein the water-soluble fluorescent whitening agent is a compound of formula

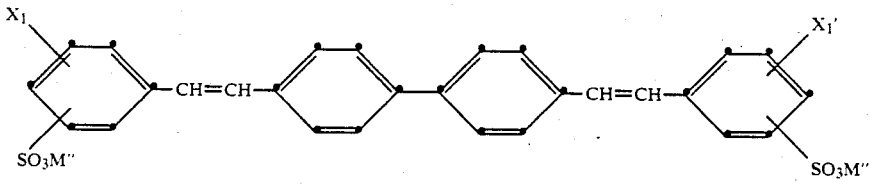

(20)

wherein $X_1$ and $X_1'$ are H or Cl and M'' is H, ammonium or $C_1$–$C_4$alkylammonium and, where appropriate, Li, Na or K.

16. A dispersion according to claim 4, wherein the water-soluble fluorescent whitening agent is a compound of formula

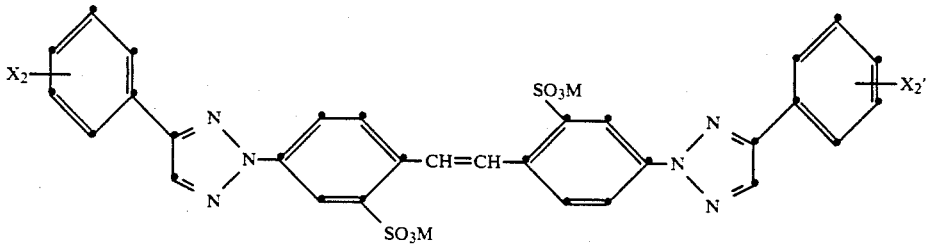

(21)

wherein $X_2$ and $X_2'$ are H, $SO_3M$ and M is Li, Na, K, ammonium or $C_1$–$C_4$alkylammonium.

17. A dispersion according to claim 4, which comprises a mixture of a water-soluble compound of formula

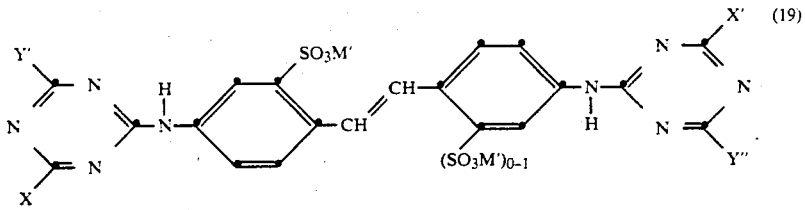

(19)

wherein X and X' are aniline, aniline-3-sulfonic acid, aniline-4-sulfonic acid, aniline-2,5-disulfonic acid or salts thereof or methanol, Y' and Y'' are aniline, ethanolamine, diethanolamine, N-methylethanolamine, diisopropanolamine, ethylamine, diethylamine, morpholine, diethylene glycol, propylene glycol, aminoethanesulfonic acid or salts thereof, ethanolaminopropionamide, cyanoethylbenzylamine, cyanoethylethanolamine, and M' is H, Li, Na, K, ammonium or $C_1$–$C_4$alkylammonium; a water insoluble compound of formula

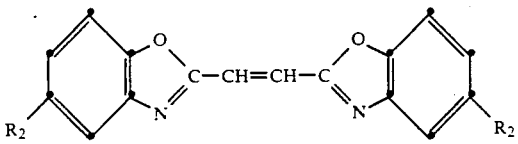

(3)

and/or a compound of formula

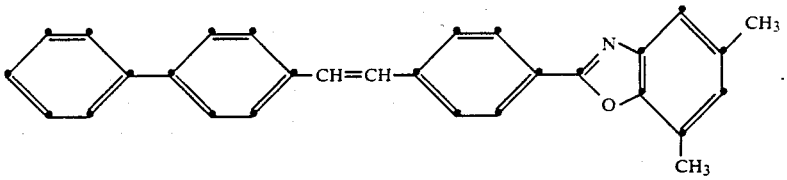

(5)

wherein $R_2$ is $C_1$–$C_4$alkyl and n is 0 to 2.

18. A dispersion according to claim 4, which comprises a mixture of a water-soluble compound of formula

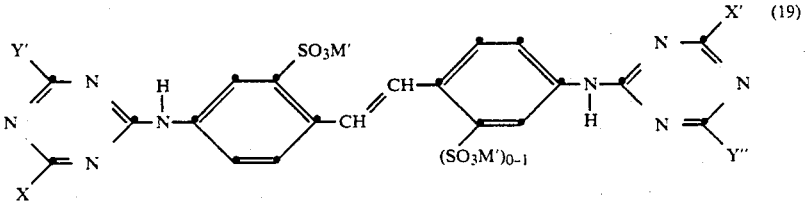

(19)

wherein X and X' are aniline, aniline-3-sulfonic acid, aniline-4-sulfonic acid, aniline-2,5-disulfonic acid or salts thereof or methanol, Y' and Y'' are aniline, ethanolamine, diethanolamine, N-methylethanolamine, diisopropanolamine, ethylamine, diethylamine, morpholine, diethylene glycol, propylene glycol, aminoethanesulfonic acid or salts thereof, ethanolaminopropionamide, cyanoethylbenzylamine, cyanoethylethanolamine, and M' is H, Li, Na, K, ammonium or $C_1$–$C_4$alkylammonium; a water-insoluble compound of formula

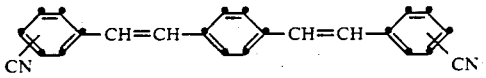

a compound of formula

19. A dispersion according to claim 4, which comprises a mixture of a water-soluble compound of formula

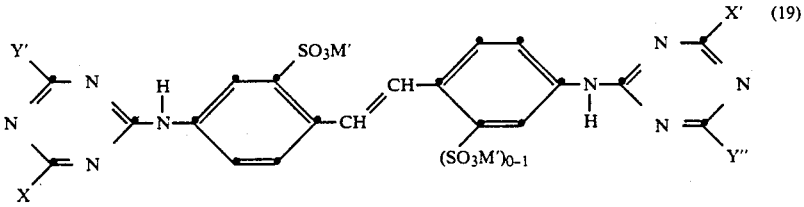

(19)

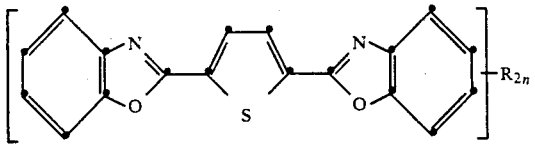

wherein X and X' are aniline, aniline-3-sulfonic acid, aniline-4-sulfonic acid, aniline-2,5-disulfonic acid or salts thereof or methanol, Y' and Y'' are aniline, ethanolamine, diethanolamine, N-methylethanolamine, diisopropanolamine, ethylamine, diethylamine, morpholine, diethylene glycol, propylene glycol, aminoethanesulfonic acid or salts thereof, ethanolamiopropionamide, cyanoethylbenzylamine, cyanoethylethanolamine, and M' is H, Li, Na, K, ammonium or $C_1$–$C_4$alkylammonium; a water-insoluble compound of formula

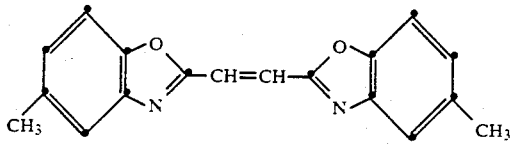

and a compound of formula

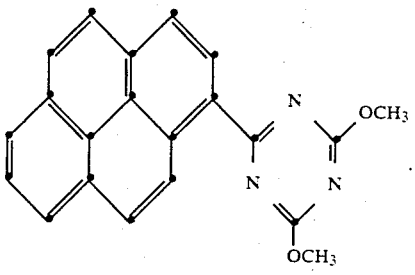

20. A dispersion according to claim 4, which comprises a water-insoluble compound of formula

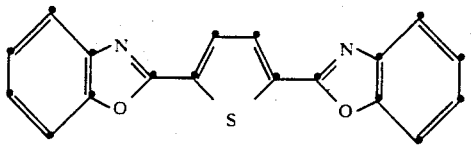

and a water-soluble compound of formula

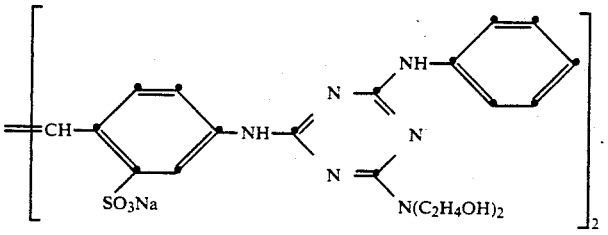

21. A dispersion according to claim 1, which comprises 5–10% of at least one water-insoluble or sparingly soluble fluorescent whitening agent selected from the class of the bis(benzoxazole)thiophenes, 4–10% of at least one water-soluble fluorescent whitening agent selected from the class of the bis(triazinyl)diaminostilbenedisulfonic acids, 2–5% of ethoxylated $C_{16}$–$C_{18}$fatty alcohol or ethylene oxide/propylene oxide block polymer as dispersant, 3–6% of a copolymer of 2-vinylpyrrolidone and 3-vinylpropionic acid, and 14–16% of polyethylene glycol or 10–25% of urea as solubiliser, 0–0.5% of shading dye and 0.1–0.5% of formaldehyde as further assistants.

22. A method for whitening polyester/cellulose fibre material, which comprises the step of applying an aqueous dispersion to the fibre material said dispersion comprising at least one water-insoluble or sparingly soluble fluorescent whitening agent, at least one water-soluble fluorescent whitening agent, an optional solubilizer, at least one anionic, cationic or non-ionic dispersant and further optional assistants, which dispersion additionally comprises a copolymer of 2-vinylpyrrolidone and 3-vinylpropionic acid.

23. The method of claim 22 carried out as a single step exhaust process.

* * * * *